US006415931B1

(12) United States Patent
Mueller

(10) Patent No.: US 6,415,931 B1
(45) Date of Patent: Jul. 9, 2002

(54) FEED SPRING

(75) Inventor: Michael A. Mueller, Phoenix, AZ (US)

(73) Assignee: The Hillman Group, Inc., Cincinnati, OH (US)

( * ) Notice: Subject to any disclaimer, the term of this patent is extended or adjusted under 35 U.S.C. 154(b) by 0 days.

(21) Appl. No.: 09/810,655

(22) Filed: Mar. 19, 2001

Related U.S. Application Data

(60) Provisional application No. 60/190,572, filed on Mar. 20, 2000.

(51) Int. Cl.[7] ..... A47F 7/00
(52) U.S. Cl. ..... 211/59.3
(58) Field of Search ..... 211/59.3, 51, 43, 211/52, 53, 54.1, 59.2

(56) References Cited

U.S. PATENT DOCUMENTS 5,027,957 A * 7/1991 Skalski
5,449,076 A * 9/1995 Van Noord
6,015,051 A * 1/2000 Battaglia
6,082,558 A * 7/2000 Battaglia
6,105,791 A * 8/2000 Chalson et al.
6,109,458 A * 8/2000 Walsh et al.
6,155,437 A * 12/2000 Rassent

* cited by examiner

*Primary Examiner*—Alvin Chin-Shue
*Assistant Examiner*—Sarah Purol
(74) *Attorney, Agent, or Firm*—Finnegan, Henderson, Farabow, Garrett & Dunner, L.L.P.

(57) ABSTRACT

A feed spring for use in displaying items in a display rack is disclosed. The feed spring comprises a sheet of elastic material configured to be formed into a hollow three-dimensional object. The hollow three-dimensional object is secured to the display rack and is compressible to provides a biasing force to position display items in the display rack. The feed spring is maintained as the hollow three-dimensional object in its uncompressed and compressed configurations by interlocking tabs, adhesives, double sided tapes, or other suitable securement mechanism. The feed spring may be suitably secured to the display rack by attachment to the frames of the display rack or other suitable securement means. Preferably, the hollow three-dimensional object in its uncompressed configuration is a hollow cylinder formed by rolling the sheet of elastic material.

20 Claims, 6 Drawing Sheets

FEED SPRING

RELATED APPLICATIONS

This application claims the benefit of U.S. provisional application no. 60/190,572, filed on Mar. 20, 2000, which is expressly incorporated herein by reference.

BACKGROUND OF THE INVENTION

This invention generally relates to devices for maintaining items in display spaces. More particularly, the present invention relates to a feed spring for positioning an item or items in a display space.

Retail items, such as letters, numbers, or signs, need to be visibly displayed at the point of purchase so that customers may examine them before making purchase decisions. Typically, a stack of letters, numbers, or signs is positioned in a display rack or a display bin without a securement mechanism. Without a securement mechanism, however, letters, numbers, or signs cannot be continuously maintained in an upright position as they are removed from a stack. For example, without a securement mechanism, letters, numbers, or signs may fall down as customers remove them from a stack. If a stack of letters, numbers, or signs cannot be maintained in an upright position, customers may not be able to examine their content easily and retailers may loose potential sales as a result.

Therefore, there is a need for a device that will continuously maintain a stack of letters, numbers, or signs in an upright position in a given display space as they are removed from the stack.

SUMMARY OF THE INVENTION

Accordingly, the present invention is directed to a feed spring for maintaining retail items, such as letters, numbers, or signs in a display space. The advantages and purposes of the invention will be set forth in the description which follows, and in part will be obvious from the description, or will be realized and attained by the elements and combinations particularly pointed out in the appended claims.

To attain the advantages and in accordance with the purpose of the invention, as embodied and broadly described herein, the invention is directed to a feed spring for use in displaying items in a display rack having a plurality of frames. The feed spring comprises a sheet of elastic material configured to be formed into a hollow three-dimensional object. The hollow three-dimensional object is compressible to provide a biasing force to position an item in the display rack. The sheet of elastic material includes at least two slits spaced apart from each other by a distance corresponding to a distance between two frames of the display rack. Each slit has at each end thereof a hole configured to engage a frame of the display rack to secure the hollow three-dimensional object to the display rack.

In another aspect, the invention is directed to a feed spring for use in displaying items in a display rack having a plurality of frames. The feed spring comprises a sheet of elastic material configured to be formed into a hollow three-dimensional object. The hollow three-dimensional object is compressible to provide a biasing force to position an item in the display rack. The sheet of elastic material includes first and second slits spaced apart from each other by a distance corresponding to a distance between two frames of the display rack and third and fourth slits to be aligned with the first and second slits when the sheet of elastic material is formed into the hollow three-dimensional object. Each of the four slits has at one end thereof a hole configured to engage a frame of the display rack to secure the hollow three-dimensional object to the display rack.

In yet another aspect, the invention is directed to a feed spring for use in displaying items in a display bin. The feed spring comprises a sheet of elastic material configured to be formed into a hollow three-dimensional object and a means for securing the hollow three-dimensional object to the display bin. The hollow three-dimensional object is compressible to provide a biasing force to position an item in the display bin.

In yet another aspect, the invention is directed to an apparatus for displaying items. The apparatus comprises a display rack and a feed spring. The display rack has a plurality of frames. The feed spring comprises a sheet of elastic material configured to be formed into a hollow three-dimensional object. The hollow three-dimensional object is compressible to provide a biasing force to position an item in the display rack. The sheet of elastic material includes at least two slits spaced apart from each other by a distance corresponding to a distance between two frames of the display rack. Each slit has at each end thereof a hole configured to engage a frame of the display rack to secure the hollow three-dimensional object to the display rack.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments of the invention and together with the description, serve to explain the principles of the invention. In the drawings.

DETAILED DESCRIPTION

Reference will now be made in detail to the presently preferred embodiments of the present invention, examples of which are illustrated in the accompanying drawings. Wherever possible, the same reference numbers will be used throughout the drawings to refer to the same or like parts.

In accordance with the present invention, there is provided a feed spring for use in displaying items in a display rack having a plurality of frames. The feed spring comprises a sheet of elastic material configured to be formed into a hollow thee-dimensional object. The hollow thee-dimensional object is compressible to provide a biasing force to position an item in the display rack. The sheet of elastic material includes at least two slits spaced apart from each other by a distance corresponding to a distance between two frames of the display rack. Each slit has at each end thereof a hole configured to engage a frame of the display rack to secure the hollow thee-dimensional object to the display rack.

Figure 1:
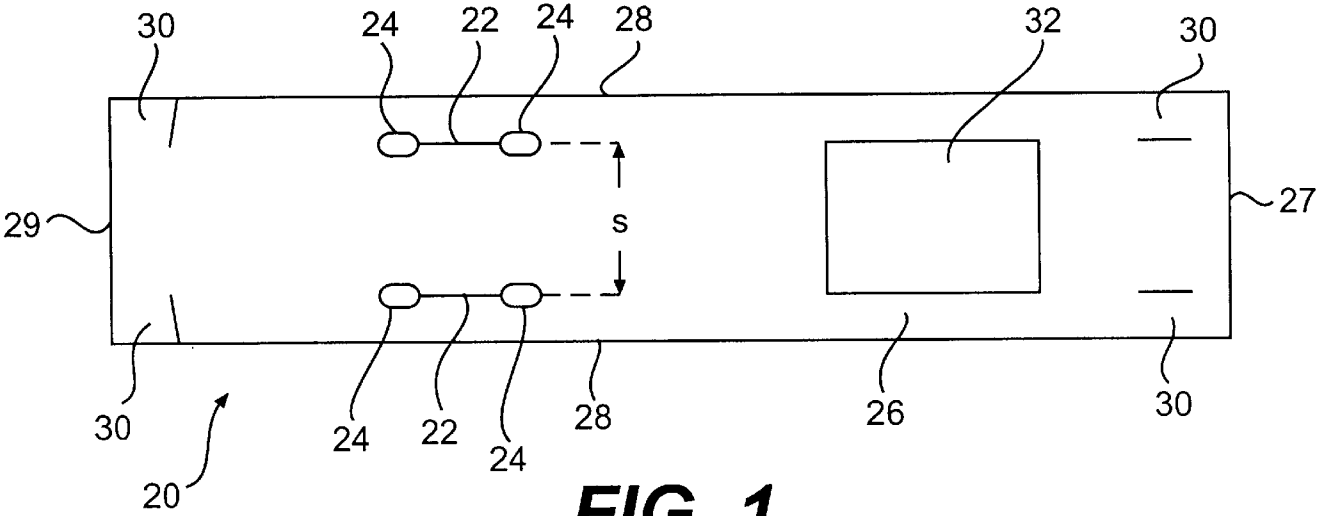
FIG. 1 is a plan view of an exemplary feed spring in its unassembled configuration according to the present invention.
Figure 6:
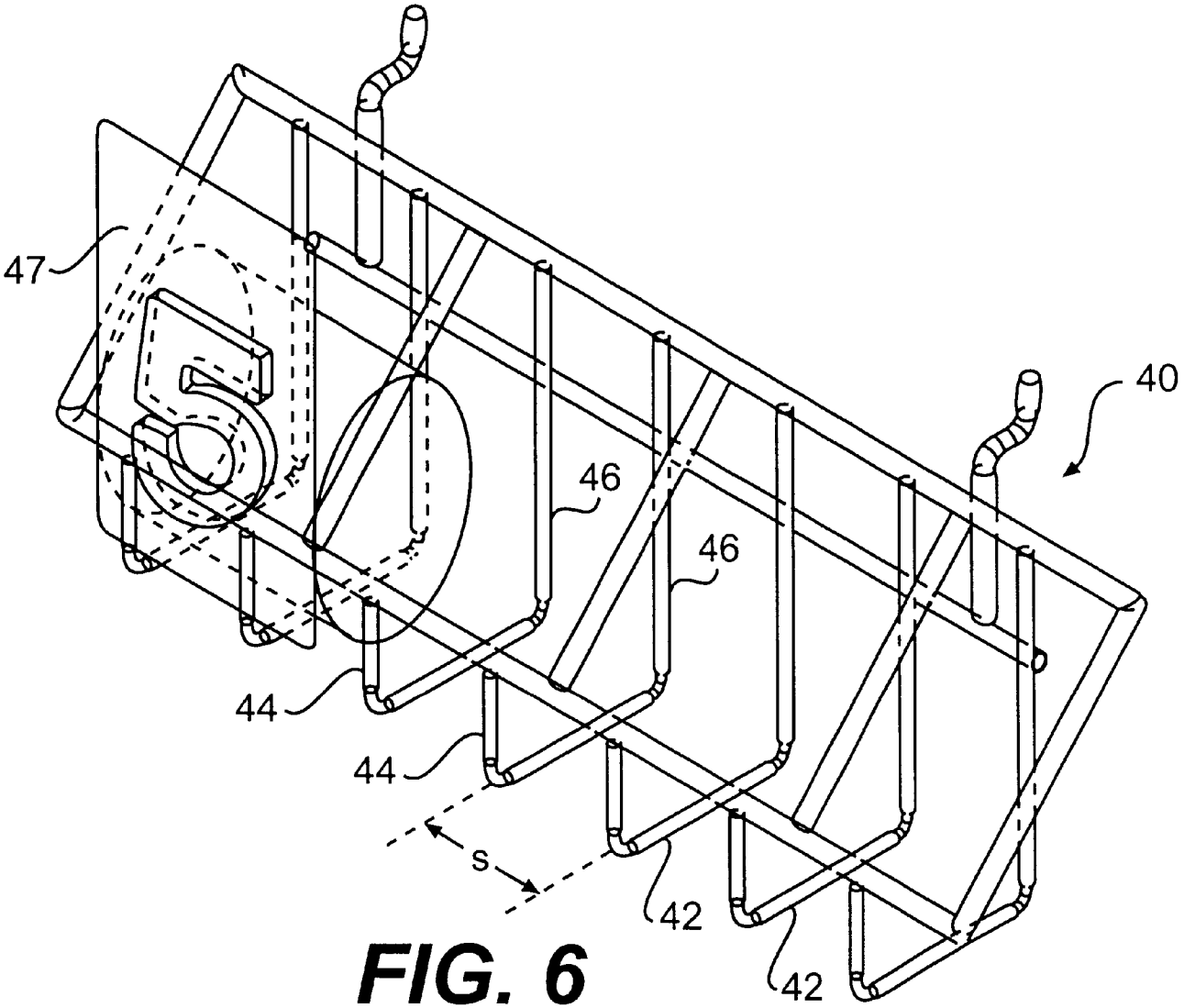
FIG. 6 is a perspective view of a feed spring and a display rack according to the present invention.

In the embodiment illustrated in FIG. 1, a feed spring 20 is shown in its unassembled configuration of a flat sheet 26. Flat sheet 26 includes side edges 28, a top edge 27, a bottom edge 29, and a pair of slits 22. Each slit 22 has a hole 24 at each end thereof. Slits 22 are preferably spaced apart by a distance s corresponding to a distance between two adjacent bottom 42 or back 46 wire frames of a display rack 40 (FIG. 6). The distance s, however, does not have to correspond to the distance between two adjacent bottom 42 or back 46 wire frames of display rack 40. Instead, it may correspond to a distance between any two bottom 42 or back 46 wire frames of display rack 40. As will be explained in greater detail below, feed spring 20 is secured to display rack 40 by inserting bottom 42 or back 46 wire frames through corresponding slits 22 and engaging them with holes 24.

Figure 3:
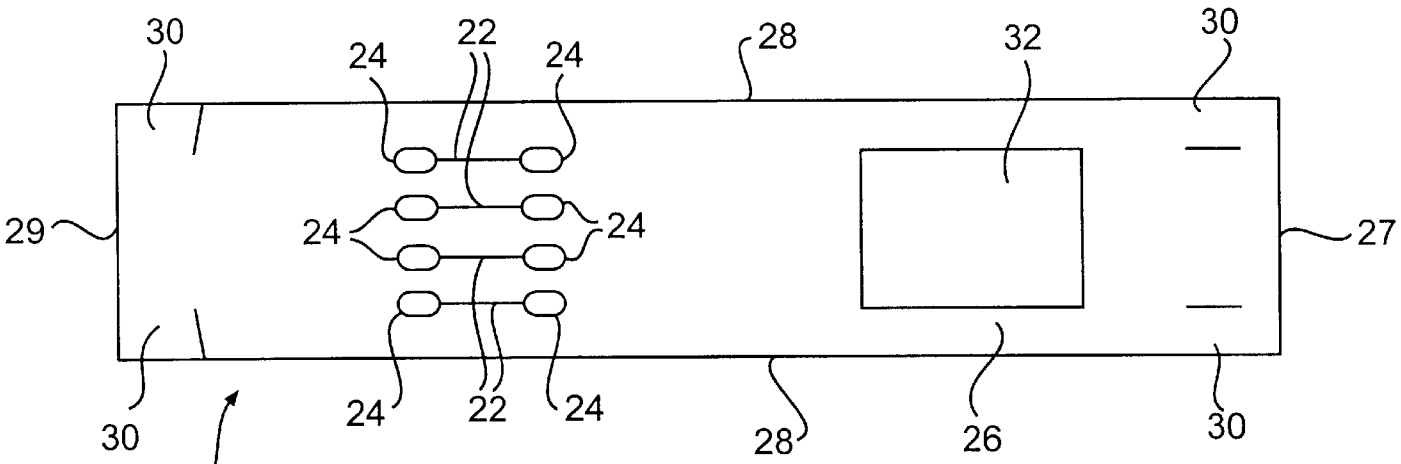
FIG. 3 is a plan view of another exemplary feed spring in its unassembled configuration according to the present invention.

As illustrated in FIG. 3, feed spring 20 may have a plurality of slits 22 rather than only a pair of slits 22 as shown in FIG. 1. Preferably, at least two of slits 22 are spaced apart by a distance corresponding to a distance between two adjacent bottom 42 or back 46 wire frames of display rack 40. As mentioned above, however, at least two of slits 22 may be spaced apart by a distance corresponding to a distance between any two bottom 42 or back 46 wire frames of display rack 40. In addition, the distance between each two adjacent slits 22 may vary so that feed spring 20 can be used for display racks having different wire frame spacings. Of course, each two adjacent slits 22 may be spaced apart by a distance corresponding to the distance between two adjacent wire frames 42 of display rack 40 so that a plurality of bottom 42 or back 46 wire frames are inserted through all slits 22.

In accordance with the present invention, flat sheet 26 is formed into a hollow three-dimensional object in its assembled, uncompressed configuration. The hollow three-dimensional object is compressible to provide a biasing force. In the illustrated embodiments shown in FIGS. 2 and 4, flat sheet 26 is rolled into a hollow cylinder 34 having a circular cross section in its assembled, uncompressed configuration. The cross section, however, changes when hollow cylinder 34 is compressed.

Figure 2:
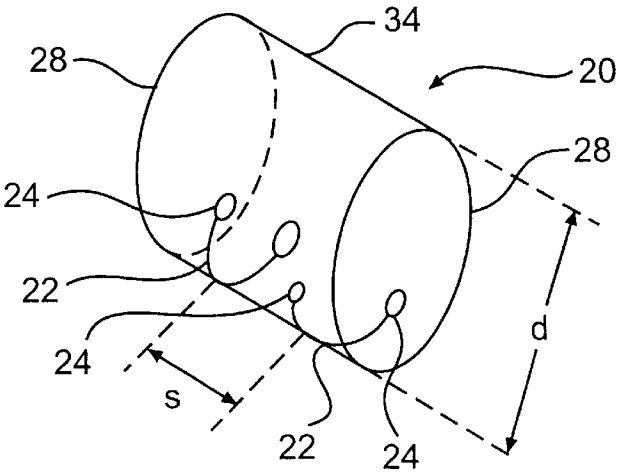
FIG. 2 is a perspective view of the feed spring of FIG. 1 in its assembled, uncompressed configuration.
Figure 4:
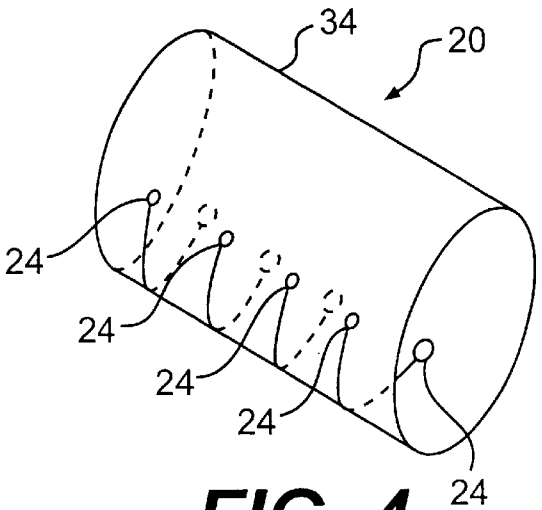
FIG. 4 is a perspective view of the feed spring of FIG. 3 in its assembled, uncompressed configuration.

Although the illustrated embodiments shown in FIGS. 2 and 4 show a feed spring in the form of a hollow cylinder having a circular cross section in its assembled, uncompressed configuration, other hollow three-dimensional objects having different cross sections are within the scope of the present invention. For example, flat sheet 26 may be formed into other hollow three-dimensional objects having cross sections, such as ovals, ellipses, squares, rectangles, triangles, trapezoids, diamonds, or any combination thereof. For the purpose of illustrating the principles of the present invention, however, the following description is directed to a hollow cylinder having a circular cross section.

Figure 8:
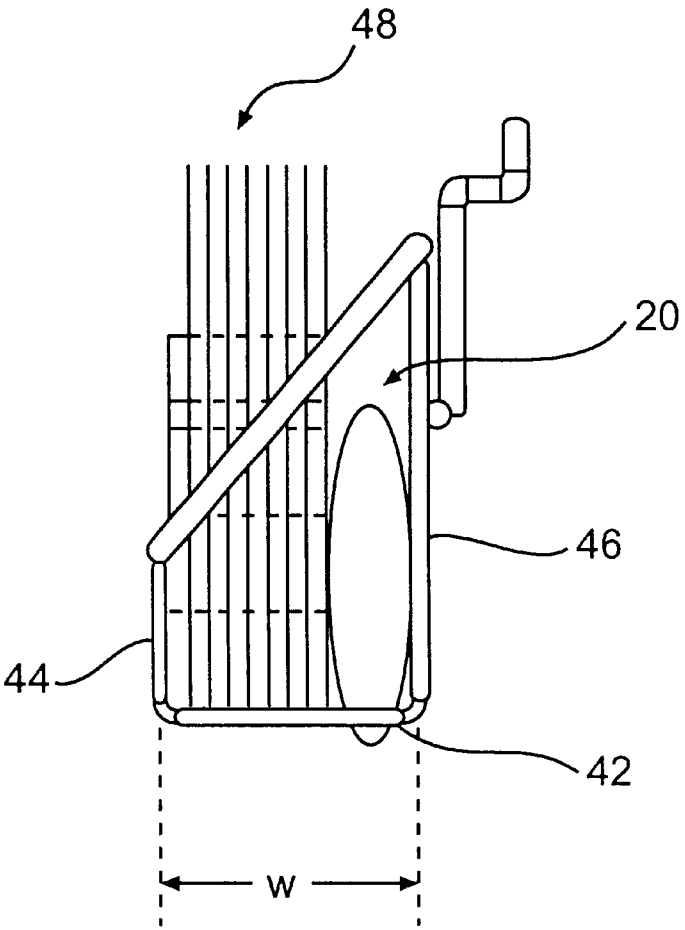
FIG. 8 is a side view of a feed spring and a display rack according to the present invention, showing a stack of display items.

As shown in FIGS. 1 and 3, flat sheet 26 includes interlocking tabs 30 provided around top 27 and bottom 29 edges. The uncompressed configuration shown in FIGS. 2 and 4 is achieved by rolling flat sheet 26 into a hollow cylinder 34. When flat sheet 26 is rolled into hollow cylinder 34, top edge 27 and bottom edge 29 overlap each other and each side edge 28 becomes a circle with a diameter d. Interlocking tabs 30 provided around top 27 and bottom 29 edges engage each other to maintain flat sheet 26 as hollow cylinder 34 in its uncompressed configuration (FIGS. 2 and 4). When hollow cylinder 34 is compressed to provide a biasing force, the circular cross section of hollow cylinder 34 changes its shape. For example, the circular cross section becomes elliptical (FIGS. 6 and 8) when hollow cylinder 34 is compressed from its uncompressed configuration. However, interlocking tabs 30 remain engaged to each other even when hollow cylinder 34 is compressed (FIGS. 6 and 8).

Alternatively, other suitable securement mechanism other than interlocking tabs 30 may be used to maintain feed spring 20 in its uncompressed (FIGS. 2 and 4) and compressed (FIGS. 6 and 8) configurations. For example, flat sheet 26 may include preapplied adhesives or double-sided tapes around top 27 or bottom 28 edges. Preapplied adhesives or double-sided tapes may be protected by a thin plastic cover for shipping and storage. In addition, adhesives or double-sided tapes, stored separately from flat sheet 26 and applied to top 27 or bottom 28 edges when feed spring 20 is to be assembled, are within the scope of the present invention.

Feed spring 20 is secured to display rack 40 by inserting bottom 42 or back 46 wire frames through corresponding slits 22 and engaging them with holes 24. As will be explained in greater detail below, depending on the size of flat sheet 26 selected, hollow cylinder 34 may be compressed or remain in its uncompressed configuration when it is secured to display rack 40. Although FIGS. 6-9 illustrate holes 24 engaging bottom wire frames 42, they may instead engage back wire frames 46.

Holes 24 are shaped and sized to engage bottom 42 or back 46 wire frames of display rack 40. Depending on the shape and size of bottom 42 or back 46 wire frames, holes 24 may assume many different shapes, including but not limited to circles, ovals, elipses, squares, rectangles, triangles, trapezoids, diamonds, or any combination thereof. Preferably, the size of holes 24 is substantially the same as that of bottom 42 or back 46 wire frames. However, the size of holes 24 may be bigger or smaller than that of bottom 42 or back 46 wire frames.

Figure 7:
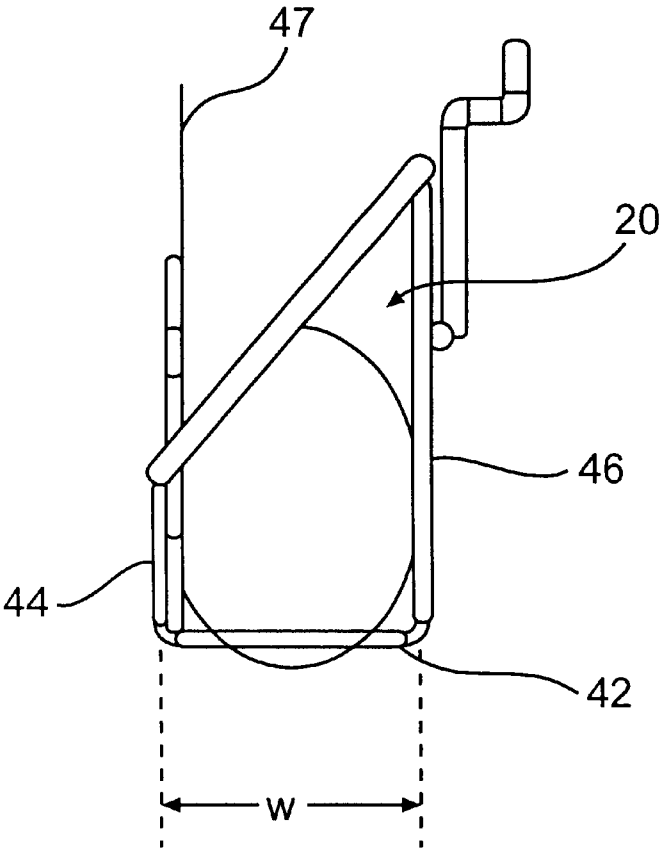
FIG. 7 is a side view of a feed spring and a display rack according to the present invention, showing a single display item.

As illustrated in FIGS. 7 and 8, display rack 40 has a width w between front wire frames 44 and back wire frames 46. Preferably, flat sheet 26 is selected so that the diameter d of hollow cylinder 34 in its uncompressed configuration is greater than the width w of display rack 40. This selection ensures that hollow cylinder 34 is precompressed against both front wire frames 44 and back wire frames 46 when feed spring 20 is secured to display rack 40. As a result, hollow cylinder 34 provides a biasing force to position even a single display item 47 of any thickness.

The diameter d, however, may be smaller than the width w of display rack 40 if display item 47 has a sufficient thickness to compress hollow cylinder 34 against back wire frames 46 when placed in display rack 40. In other words, if the diameter d of hollow cylinder 34 in its uncompressed configuration plus the thickness of display item 47 is greater than the width w of display rack 40, hollow cylinder 34 will provide a biasing force to position display item 47 in display rack 40.

Feed spring 20 tends to expand back to hollow cylinder 34 when compressed and, therefore, provides a biasing force to position display item 47 or a stack 48 of display items 47 in display rack 40. Thus, any elastic material may be used for feed spring 20. Preferably, feed spring 20 is made of plastic, although other elastic materials, such as rubbers or elastic metals, are within the scope of the present invention. The biasing force applied to display items 47 may be adjusted by changing the thickness or size of flat sheet 26. Preferably, feed spring 20 positions display items 47, such as letters, numbers, and signs, forward and upright in display rack 40. However, feed spring 20 may position other display items in display rack 40 without departing from the principles of the present invention.

Flat sheet 26 is preferably made of a translucent material and includes a writeable portion 32 provided on a surface thereof. When flat sheet 26 is rolled into hollow cylinder 34, writeable portion 32 preferably becomes a portion of the inner surface of hollow cylinder 34 so that a message written thereon does not contact display items 47. A message written on writeable portion 32, however, is visible from outside when flat sheet 26 is made of a translucent material.

Although flat sheet 26 is preferably made of a translucent material, flat sheet 26 made of non-translucent materials is also within the scope of the present invention. When such non-translucent materials are used, writeable portion 32 should become a portion of the outer surface of hollow cylinder 34 so that a message written thereon is visible from outside.

Figure 5:
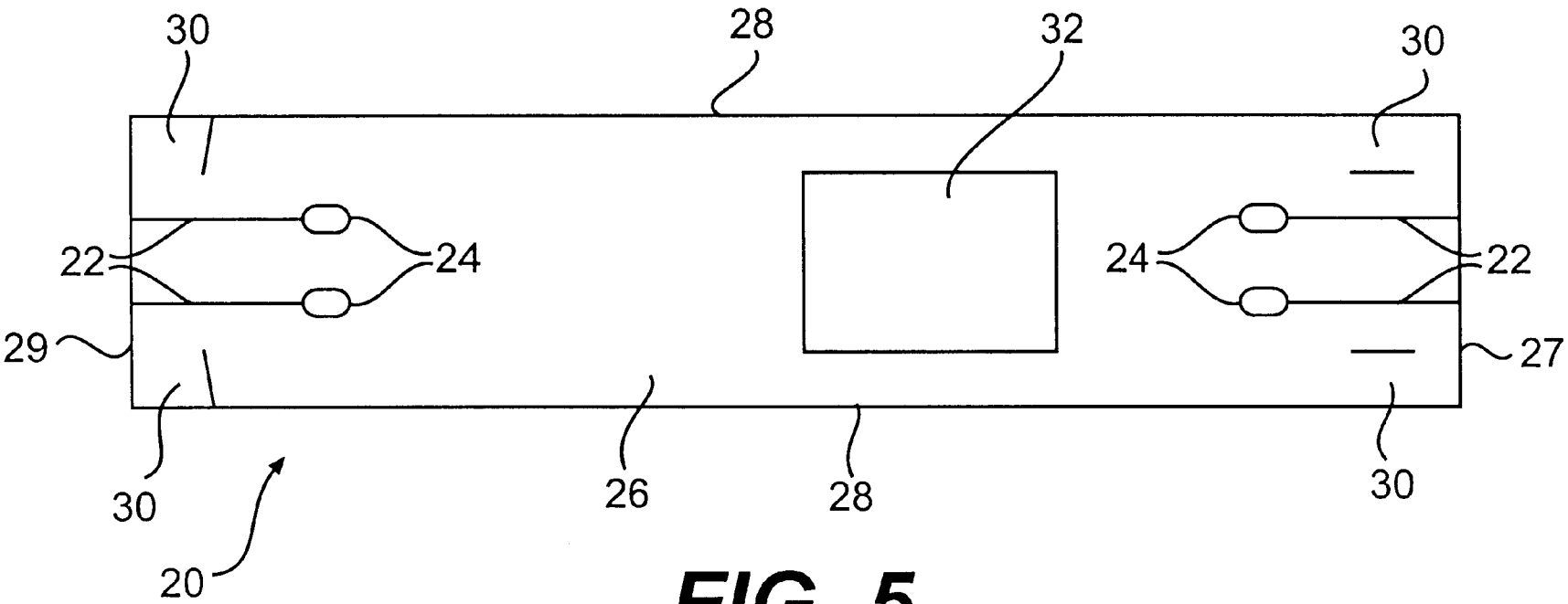
FIG. 5 is a plan view of yet another exemplary feed spring in its unassembled configuration according to the present invention.

In accordance with the present invention, FIG. 5 illustrates another exemplary embodiment of the present invention. Unlike the embodiment shown in FIG. 1, which has slits 22 formed within edges 27, 28 and 29, the embodiment shown in FIG. 5 includes a pair of slits 22 extending from top edge 27 toward bottom edge 29 and another pair of slits 22 extending from bottom edge 29 toward top edge 27. Each slit 22 has a hole 24 at one end thereof away from top 27 and bottom 29 edges. Two pairs of slits 22 align with each other when flat sheet 26 is rolled into hollow cylinder 34. As a result, top 27 and bottom 29 edges and slits 22 face generally the same direction because they are located in the same proximate location on hollow cylinder 34. Thus, top 27 and bottom 29 edges are not visible from the top of display rack 40 when feed spring 20 is secured to display rack 40. Alternatively, like the embodiment shown in FIG. 3, the embodiment shown in FIG. 5 may be modified to include a plurality of slits 22 extending from top 27 and bottom 29 edges rather than only a pair of slits 22. All other aspects of the embodiment shown in FIG. 5 are the same as those shown in FIG. 1 and FIG. 3.

The embodiments illustrated in FIGS. 1, 3, and 5 may also be used for a display bin having walls instead of wire frames. For example, in addition to or as an alternative to slits 22 and holes 24, the embodiments illustrated in FIGS. 1, 3, and 5 may include preapplied adhesives or double-sided tapes provided on a surface thereof to secure feed spring 20 to a wall (e.g., a back wall) of a display bin. Preapplied adhesives or double-sided tapes may be protected by a thin plastic cover for shipping and storage. Moreover, adhesives or double-sided tapes, stored separately from flat sheet 26 and applied to a surface of feed spring 20, are within the scope of the present invention.

A feed spring having adhesives or double-sided tapes in addition to slits 22 and holes 24 may be used for display bins having no wire frames as well as display racks having wire frames. On the other hand, a feed spring having adhesives or double-sided tapes as an alternative to slits 22 and holes 24 may be primarily used for a display bin having no wire frames. However, a feed spring having adhesives or double-sided tapes as an alternative to slits 22 and holes 24 may also be used for display racks having wire frames provided that the wire frames have a sufficient surface area for a secure attachment with adhesives or double-sided tapes.

The assembly and operation of the aforementioned feed spring will now be described with reference to the attached drawings.

As illustrated in FIGS. 1, 3, and 5, feed spring 20 may be manufactured, shipped and stored in its unassembled configuration as flat sheet 26. Depending on the size, weight, and thickness of display item 47 as well as the width w of display rack 40, flat sheet 26 of appropriate thickness and size is selected. Flat sheet 26 is then rolled into hollow cylinder 34 in its assembled, uncompressed configuration and maintained as such (FIGS. 2 and 4) using interlocking tabs 30, adhesives, double-sided tapes, or other suitable securement mechanism. A message may be written on writeable portion 32 of flat sheet 26 before it is rolled into hollow cylinder 34. For example, a message such as "Reorder Item Number XXXXX" may be written on writeable portion 32.

Figure 9:
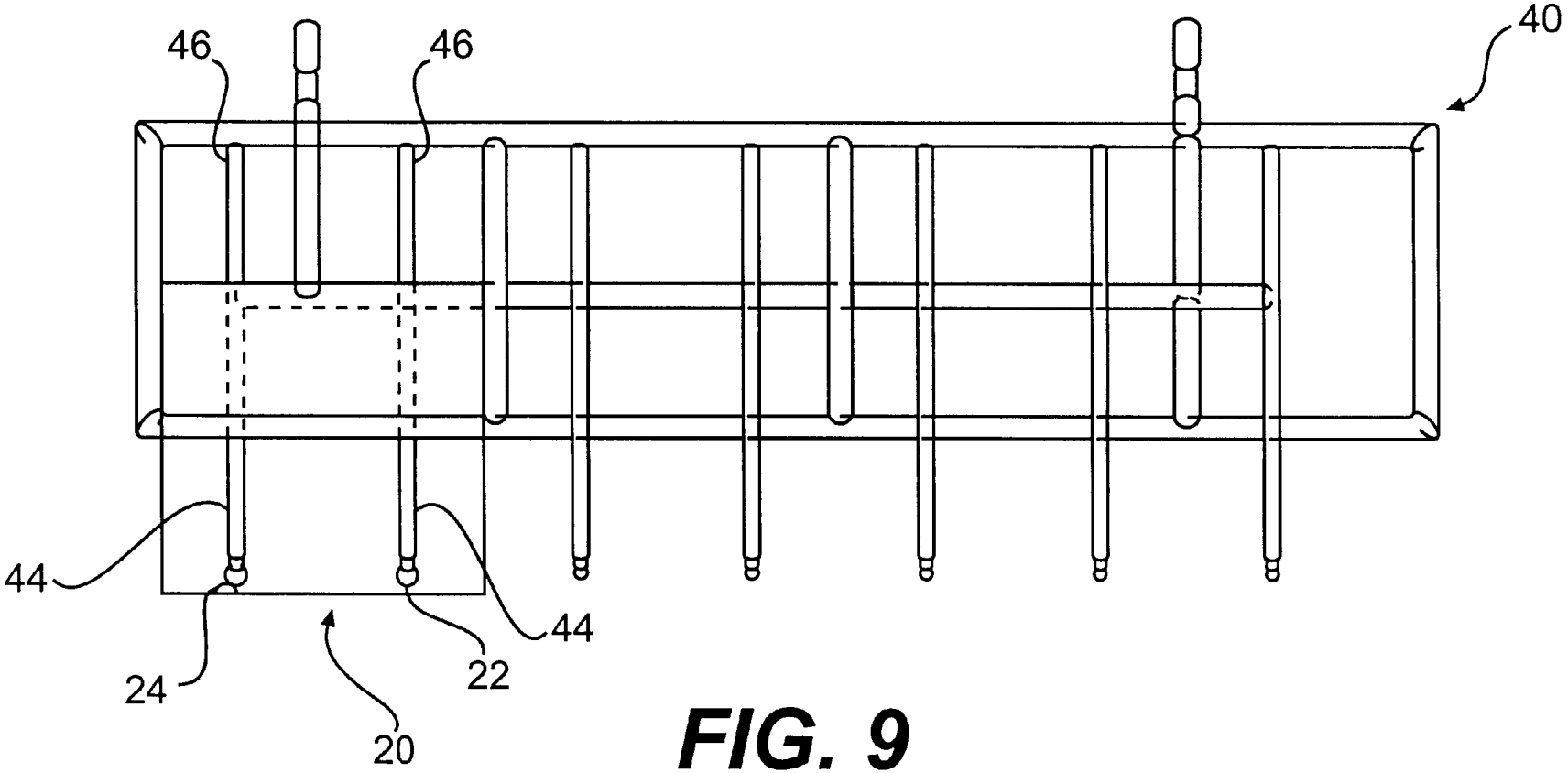
FIG. 9 is a front view of an empty display rack and a feed spring according the present invention.

As illustrated in FIGS. 6 and 9, feed spring 20 is secured to display rack 40 by inserting bottom wire frames 42 through slits 22 and engaging them with holes 24. Alternatively, back wire frames 46 instead of bottom wire frames 42 may be inserted through slits 22. Instead of inserting back wire frames 46 or bottom wire frames 42 through slits 22, feed spring 20 may also be secured to display rack 40 by adhesives or double-sided tapes if back wire frames 46 or bottom wire frames 42 have a sufficient surface area for a secure attachment with adhesives or double-sided tapes. For a display bin having no wire frames, feed spring 20 may be secured to the display bin by adhesives, double-sides tapes, or other suitable securement mechanism.

Preferably, flat sheet 26 of sufficient size is selected so that hollow cylinder 34 is precompressed when secured to display rack 40 or a display bin without any display items. This selection ensures that even a single display item 47 of any thickness may be maintained in an upright position (FIG. 7) when placed in display rack 40. However, flat sheet 26 may be reduced in size if a single display item 47 to be displayed is of sufficient thickness to compress hollow cylinder 34 when placed in display rack 40 or the display bin.

As illustrated in FIG. 8, feed spring 20 may maintain a stack 48 of display items 47. When a display item is removed from stack 48, feed spring 20 expands and maintains the remaining stack in an upright position. Display items 47 may also be added by placing them at the back end of stack 48 and pushing them down. Feed spring 20 then further compresses and maintains the increased stack in an upright position. When all display items 47 are removed, the message written on writeable portion 32 becomes visible so that appropriate actions may be taken. For example, a message such as "Reorder Item Number XXXXX" written on writeable portion 32 identifies display items 47 to be replenished.

Feed spring 20 is easily detacheable from display rack 40 by disengaging holes 24 from bottom wire frame 42 and removing them through slits 22. For feed spring 20 secured to a display rack or display bin by adhesives or double-sided tapes, applying sufficient force will break the securement.

It will be apparent to those skilled in the art that various modifications and variations can be made in the device of the present invention without departing from the scope or spirit of the invention. Other embodiments of the invention will be apparent to those skilled in the art from consideration of the specification and practice of the invention disclosed herein.

What is claimed is:

1. A feed spring for use in displaying items in a display rack having a plurality of frames, the feed spring comprising:

a sheet of elastic material configured to be formed into a hollow three-dimensional object, the hollow three-dimensional object being compressible to provide a biasing force to position an item in the display rack, the sheet of elastic material including at least two slits spaced apart from each other by a distance corresponding to a distance between two frames of the display rack, each slit having at each end thereof a hole configured to engage a frame of the display rack to secure the hollow three-dimensional object to the display rack.

2. The feed spring of claim 1, wherein the hollow three-dimensional object is a hollow cylinder formed by rolling the sheet of elastic material.

3. The feed spring of claim 2, wherein the sheet of elastic material includes a means for maintaining the rolled sheet of elastic material as the hollow cylinder.

4. The feed spring of claim 3, wherein the sheet of elastic material is made of plastic.

5. The feed spring of claim 3, wherein the sheet of elastic material is made of rubber.

6. The feed spring of claim 3, wherein the sheet of elastic material is made of metal.

7. The feed spring of claim 3, wherein the sheet of elastic material is translucent and includes a writeable portion.

8. A feed spring for use in displaying items in a display rack having a plurality of frames, the feed spring comprising:

a sheet of elastic material configured to be formed into a hollow three-dimensional object, the hollow three-dimensional object being compressible to provide a biasing force to position an item in the display rack, the sheet of elastic material including first and second slits spaced apart from each other by a distance corresponding to a distance between two frames of the display rack and third and fourth slits to be aligned with the first and second slits when the sheet of elastic material is formed into the hollow three-dimensional object, each of the four slits having at one end thereof a hole configured to engage a frame of the display rack to secure the hollow three-dimensional object to the display rack.

9. The feed spring of claim 8, wherein the hollow three-dimensional object is a hollow cylinder formed by rolling the sheet of elastic material.

10. The feed spring of claim 9, wherein the sheet of elastic material includes a top edge having the first and second slits extending therefrom and a bottom edge having the third and fourth slits extending therefrom.

11. The feed spring of claim 9, wherein the sheet of elastic material includes a means for maintaining the rolled sheet of elastic material as the hollow cylinder.

12. The feed spring of claim 11, wherein the sheet of elastic material is translucent and includes a writeable portion.

13. A feed spring for use in displaying items in a display bin, the feed spring comprising:

a sheet of elastic material configured to be formed into a hollow three-dimensional object, the hollow three-dimensional object being compressible to position an item in the display bin; and a means for securing the hollow three-dimensional object to the display bin.

14. The feed spring of claim 13, wherein the hollow three-dimensional object is a hollow cylinder formed by rolling the sheet of elastic material.

15. The feed spring of claim 14, wherein the sheet of elastic material includes a means for maintaining the rolled sheet of elastic material as the hollow cylinder.

16. The feed spring of claim 15, wherein the sheet of elastic material is translucent and includes a writeable portion.

17. An apparatus for displaying items, comprising:

a display rack having a plurality of frames; and a feed spring comprising a sheet of elastic material configured to be formed into a hollow three-dimensional object, the hollow three-dimensional object being compressible to provide a biasing force to position an item in the display rack, the sheet of elastic material including at least two slits spaced apart from each other by a distance corresponding to a distance between two frames of the display rack, each slit having at each end thereof a hole configured to engage a frame of the display rack to secure the hollow three-dimensional object to the display rack.

18. The apparatus of claim 17, wherein the hollow three-dimensional object is a hollow cylinder formed by rolling the sheet of elastic material.

19. The apparatus of claim 18, wherein the sheet of elastic material includes a means for maintaining the rolled sheet of elastic material as the hollow cylinder.

20. The apparatus of claim 19, wherein the sheet of elastic material is translucent and includes a writeable portion.

* * * * *